US006147418A

United States Patent [19]

Wilson

[11] Patent Number: 6,147,418

[45] Date of Patent: Nov. 14, 2000

[54] REMOTE VEHICLE STARTING APPARATUS WITH TIMER

[76] Inventor: Bobby Wilson, 1505 County Hwy. 196, Haleyville, Ala. 35565

[21] Appl. No.: 09/176,060

[22] Filed: Oct. 20, 1998

[51] Int. Cl.[7] ..... F02N 11/12

[52] U.S. Cl. ..... 307/10.6; 123/179.2; 290/37 R

[58] Field of Search ..... 307/10.6, 10.2; 123/179.1, 179.2; 290/37 R, 38 R

[56] References Cited

U.S. PATENT DOCUMENTS

| | | | |
|---|---|---|---|
| 2,827,540 | 3/1958 | Underwood | 219/38 |
| 3,496,855 | 2/1970 | De Boer | 98/2 |
| 3,767,932 | 10/1973 | Bailey | 290/37 R |
| 3,793,529 | 2/1974 | Bucher | 123/179.2 |
| 4,131,304 | 12/1978 | Wagner | 123/179.2 |
| 4,200,080 | 4/1980 | Cook et al. | 123/179.2 |
| 4,227,588 | 10/1980 | Biancardi | 180/167 |
| 4,293,759 | 10/1981 | Higgins | 219/202 |
| 4,350,287 | 9/1982 | Richards | 237/12.3 |
| 5,115,116 | 5/1992 | Reed | 219/202 |
| 5,654,688 | 8/1997 | Allen et al. | 340/426 |
| 5,656,868 | 8/1997 | Gottlieb et al. | 307/10.6 |
| 5,680,131 | 10/1997 | Utz | 341/176 |
| 5,721,550 | 2/1998 | Lopez | 341/176 |
| 5,729,192 | 3/1998 | Badger | 340/426 |

*Primary Examiner*—Albert W. Paladini
*Attorney, Agent, or Firm*—John D. Gugliotta

[57] ABSTRACT

An improved remote vehicle starting apparatus with timer which allows for the remote starting of a motor vehicle to allow for the preheating or pre-cooking of the passenger compartment of said motor vehicle under extreme temperature conditions is disclosed. The apparatus consists of a transmitting unit, located with the driver, and a receiver unit that is located in the driver's vehicle. The transmitting unit allows the user to set predetermined times at which to start the vehicle, before work for example, and includes an LCD display that indicates both the time of day and the time(s) at which the vehicle will be started. The transmitter also includes a manual switch, by which the user may start the vehicle, regardless of the time settings. The receiver installs in the vehicle and is wired into the vehicle ignition circuitry, allowing the engine to be started by key in a conventional manner, or by the remote transmitter. Depending on the weather conditions, the user simply either leaves the cooling or heating system activated when leaving the vehicle before use of the present invention. In this manner, when the apparatus starts the motor vehicle, the passenger compartment will begin to warm or cool prior to the driver returning.

5 Claims, 5 Drawing Sheets

REMOTE VEHICLE STARTING APPARATUS WITH TIMER

BACKGROUND OF THE INVENTION

1. Field of the Invention

The present invention relates generally to vehicle starting apparatuses and more particularly, to a remote vehicle starting apparatus incorporating a timer.

2. Description of the Related Art

Motor vehicle owners know all too well of the great burdens associated with starting their vehicles in extreme temperature conditions. Whether in the heat of summer or the cold of winter, the automobile climate control system takes a considerable amount of time to take effect, during which those in the passenger compartment must endure the discomfort associated therewith. In cold weather situations, the passengers are forced to wait through the cold, often for several minutes while the engine heats up. In hot weather conditions, while air-conditioning systems cool the passenger compartment rather quickly, the sealed passenger compartment can cause the temperature therein to be elevated over outdoor temperatures. As a result, there is a need for a means by which one can avoid the discomfort associated with starting a motor vehicle under extreme temperature conditions.

The previous art consists of many examples of devices to aid individuals in heating of their motor vehicle under pre-running conditions. Examples of such prior art include the following:

| U.S. Pat. No. | Inventor | Issue Date |
|---|---|---|
| 2,827,540 | Underwood | Mar. 18, 1958 |
| 3,496,855 | DeBoer | Feb. 24, 1970 |
| 4,293,759 | Higgins | Dec. 19, 1979 |
| 5,115,116 | Reed | May 19, 1992 |

Devices constructed in accordance with these disclosures allow for the manufacture of devices that allow for the heating of the passenger compartment of motor vehicles. As such however, the inventions do not allow for the remote unattended starting of the motor vehicle, and may require connection to an additional source of power, such a separate battery in the motor vehicle or connection to a standard source of alternating current which is not always available where a car is parked. Additionally, these devices do not allow for the auxiliary cooling of the passenger compartment on those vehicles so equipped with air conditioning.

Other prior art emphasizes the enhancement of remote starting capabilities of motor vehicles. Examples of such prior art include the following:

| U.S. Pat. No. | Inventor | Issue Date |
|---|---|---|
| 4,227,588 | Biancardi | Oct. 14, 1980 |
| 4,250,287 | Richards | Sep. 21, 1982 |
| 5,656,868 | Gottlieb, et al. | Aug. 12, 1997 |
| 5,721,550 | Lopez | Feb. 24, 1998 |

Devices constructed in accordance with these disclosures allow for thus equipped motor vehicles to be started by the owner from a remote position. One disadvantage to this configuration is that when a motor vehicle is started at the same time each day such as when leaving for work or when returning home from work, the driver may forget to start the vehicle. Also, under extreme weather conditions, the motor vehicle may require a longer period of time to obtain tolerable internal temperatures inside the passenger compartment. This time may be on the order of twenty to thirty minutes. With this long of time frame, the driver may still be asleep and thus require awakening just to start the motor vehicle. This operation is certainly a detriment to the convenience features offered by conventional remote vehicle starting systems.

Consequently, a need has been felt for providing a device and method which overcomes the problems cited above.

SUMMARY OF THE INVENTION

It is therefore an object of the present invention to provide an improved remote vehicle starting apparatus with timer.

It is therefore another object of the present invention to provide an improved remote vehicle starting apparatus with timer that allows for a motor vehicle to be started by a remote control using a wireless communication path to allow for preheating or cooling of the passenger compartment of said motor vehicle.

It is therefore yet another object of the present invention to provide an improved remote vehicle starting apparatus with timer that allows for a motor vehicle to be remotely started at a preset time using an internal timer on a wireless transmitter to allow for preheating or cooling of the passenger compartment of said motor vehicle.

It is therefore another object of the present invention to provide an improved remote vehicle starting apparatus with timer that allows for the override of a preset start time or a manual start at any time using a wireless transmitter to allow for preheating or cooling of the passenger compartment of said motor vehicle.

Briefly described according to the preferred embodiment of the present invention, a remote vehicle starting apparatus with timer which allows for the remote starting of a motor vehicle to allow for the preheating or pre-cooking of the passenger compartment of said motor vehicle under extreme temperature conditions is disclosed. The apparatus consists of a transmitting unit, located with the driver, and a receiver unit that is located in the driver's vehicle. The transmitting unit allows the user to set predetermined times at which to start the vehicle, before work for example, and includes an LCD display that indicates both the time of day and the time(s) at which the vehicle will be started. The transmitter also includes a manual switch, by which the user may start the vehicle, regardless of the time settings. The receiver installs in the vehicle and is wired into the vehicle ignition circuitry, allowing the engine to be started by key in a conventional manner, or by the remote transmitter. Depending on the weather conditions, the user simply leaves the cooling or heating system activated when leaving the vehicle before use of the present invention. In this manner, when the apparatus starts the motor vehicle, the passenger compartment will begin to warm or cool prior to the driver returning.

It is a feature of the present invention to provide a device that can be easily produced using existing technology, materials and assembly techniques.

It is yet another feature of the present invention to provide a device that is simple to install, program and use in a manner that is intuitively understood by the common user.

Another advantage of the present invention is that it is simple, and therefore, inexpensive to manufacture. This savings, if passed on to the consumer, may influence the public to utilize such a device. A simple design also increases product reliability and useful product lifetime.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

In order to describe the complete relationship of the invention, it is essential that some description be given to the manner and practice of functional utility and description of a remote vehicle starting apparatus with timer.

The best mode for carrying out the invention is presented in terms of its preferred embodiment, herein depicted within the Figures.

1. Detailed Description of the Figures

Figure 1:
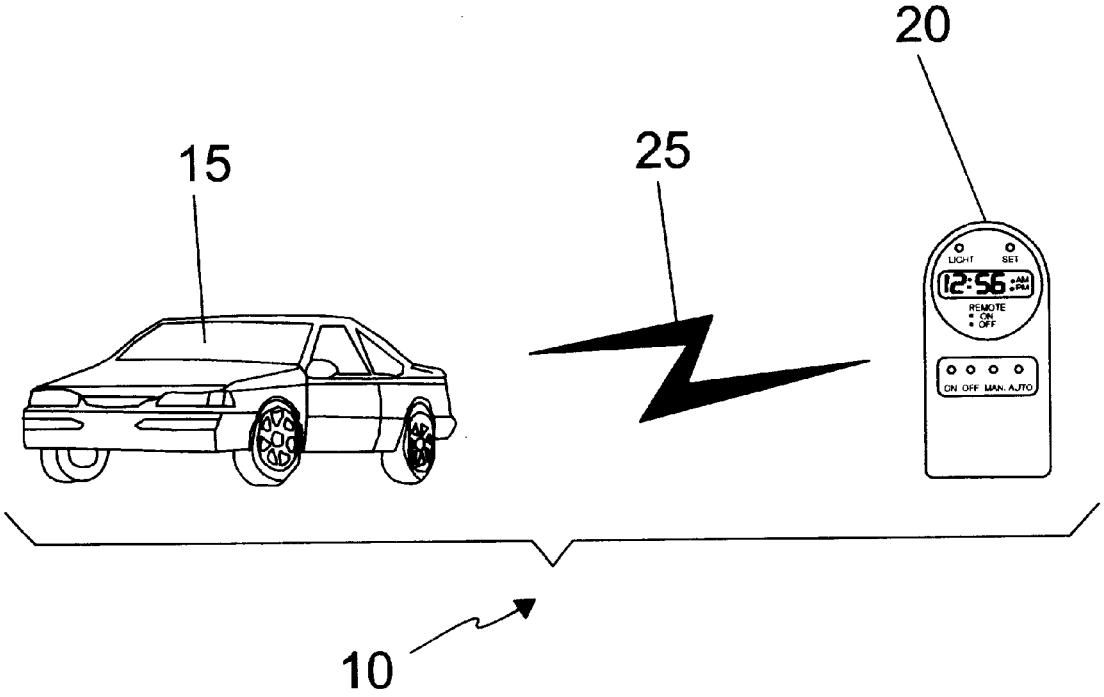
FIG. 1 is a perspective view of a remote vehicle starting apparatus with timer shown in a utilized state according to a preferred embodiment of the present invention.

Referring now to FIG. 1, a perspective view of a remote vehicle starting apparatus with timer 10 shown in a utilized state is depicted. A motor vehicle 15 is remotely started by a remote transmitting unit 20 using a wireless communication path 25 as shown. The remote transmitting unit 20 will be described in greater detail hereinbelow. The wireless communication path 25 is envisioned to be a low power radio frequency link of the type authorized by the Federal Communications Commission for such uses. As such, the effective range of such a device is on the order of one mile. Those familiar in the art will realize however that other types of links such as cellular, satellite, digital and the like could also be utilized with equal effectiveness. The motor vehicle 15 is envisioned to be equipped with air conditioning, although vehicles equipped only with a heater, such as those located in extremely cold climates, would work equally as well.

Figure 2:
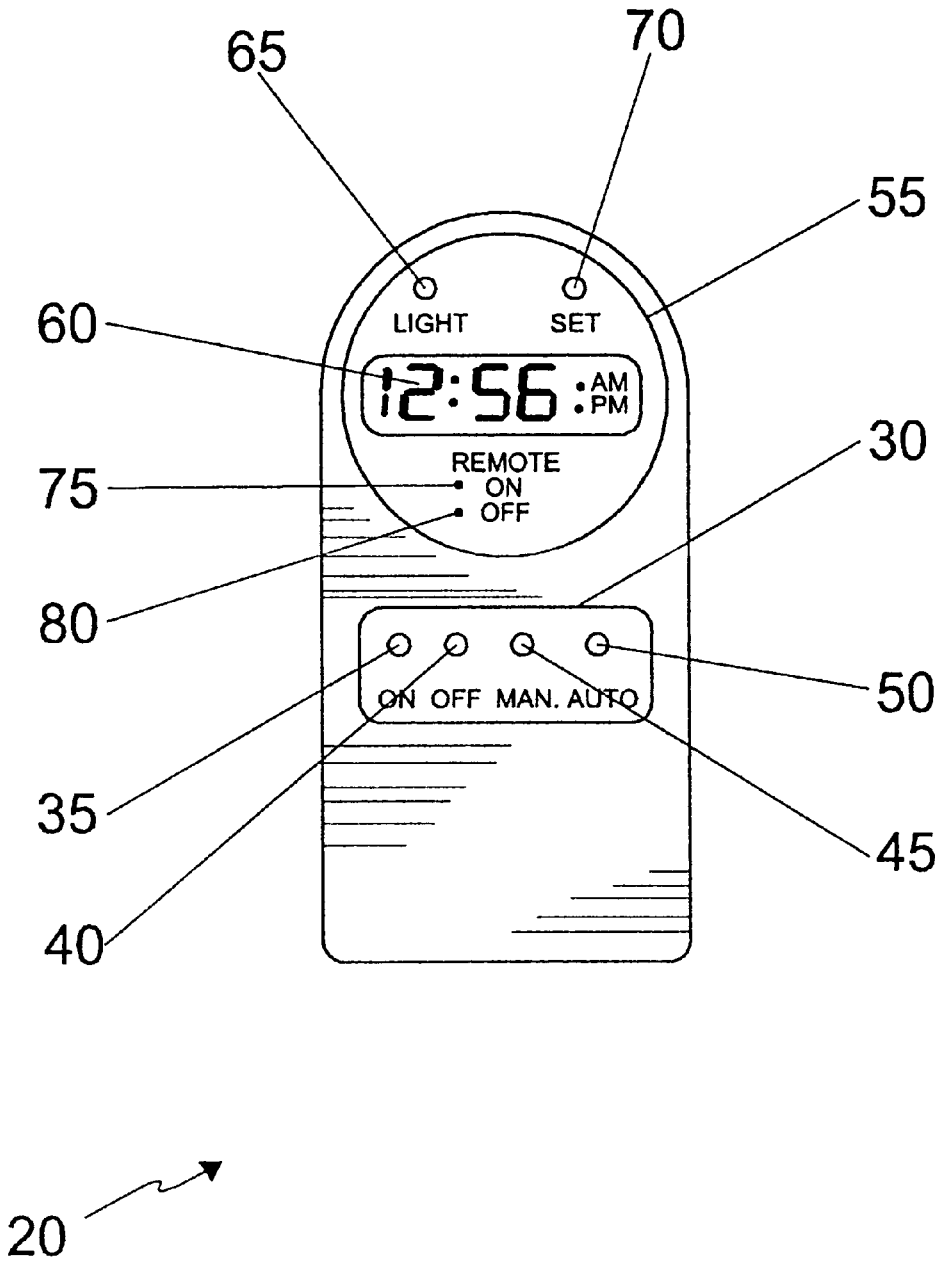
FIG. 2 is a front view of the remote transmitter.

Referring next to FIG. 2, a front view of the remote transmitting unit 20 as provided by the remote vehicle starting apparatus with timer 10 is disclosed. The remote transmitting unit 20 is envisioned to be of a hand held size with approximate dimensions of 2 inches by 5 inches. The remote transmitting unit 20 is constructed of injection molded plastic and utilizes internal high density electronic components. A control panel 30 consisting of an ON switch 35, an OFF switch 40, a manual switch 45 and an automatic switch 50 is centrally located on the remote transmitting unit 20 as shown. The ON switch 35 is used to turn the remote vehicle starting apparatus with timer 10 (not shown in this FIG.) into its "ON" condition. In a similar manner, the OFF switch 40 is used to turn the remote vehicle starting apparatus with timer 10 into its "OFF" condition. The manual switch 45 is used to send a manual start signal to the motor vehicle 15 (as shown in FIG. 1) at any time regardless of any operating condition other than "OFF" as controlled by the OFF switch 40. The automatic switch 50 is used to place the remote transmitting unit 20 into its automatic mode where it is governed by a timing module 55. The timing module 55 is located on the upper portion of the remote transmitting unit 20 and consists of a digital display 60, a back light switch 65, a time set switch 70, a REMOTE ON indicator light 75 and a REMOTE OFF indicator light 80. The digital display 60 is used to view the current time as well as the time at which the motor vehicle 15 will automatically start if so set. The digital display 60 is envisioned to be of a Liquid Crystal Display (LCD) design and is equipped with "AM" and "PM" indicators to allow for full 24-hour a day operation. The back light switch 65 allows the digital display 60 to be viewed under low-light conditions and operates in a similar manner to that found on LCD wristwatches. The time set switch 70 allows for the time of day setting as well as the automatic start time setting and operates in a similar manner to that of an alarm feature on a LCD wristwatch. The timing module 55 is also equipped with a REMOTE ON indicator light 75 and a REMOTE OFF indicator light 80 to allow the user to visually see whether a remote start signal was sent to the motor vehicle 15, if the motor vehicle 15 is not within visual range of the user. It should be noted that the arrangement of the components on the face of the remote transmitting unit 20 is for the purposes of disclosure of the operational elements of the remote vehicle starting apparatus with timer 10 (as shown in FIG. 1.) and is not intended to be a limiting factor.

Figure 3:
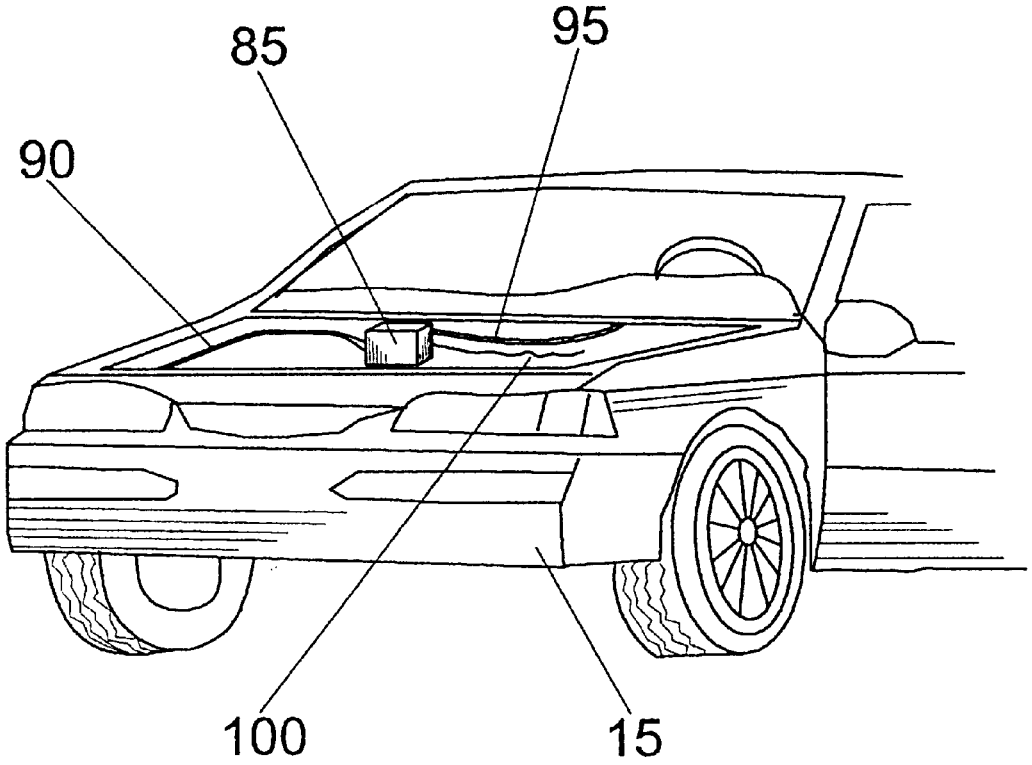
FIG. 3 is a perspective diagram of a motor vehicle depicting the internal components of the present invention installed thereon.

Referring now to FIG. 3, a perspective drawing showing the internal components of the remote vehicle starting apparatus with timer 10 (as shown in FIG. 1) is disclosed. Mounted internal to the engine compartment of the motor vehicle 15 (shown with the hood removed for purposes of clarity) is a receiver 85. Shown exiting the receiver 85, are a power connection wiring harness 90 and an ignition circuit connection wiring harness 95. The power connection wiring harness 90 connects to the battery system of the motor vehicle. The power connection wiring harness 90 is connected so that it always receives a source of electrical power, even when the motor vehicle is turned off and will be described in greater detail hereinbelow. The ignition circuit connection wiring harness 95 connects to the ignition circuit of the motor vehicle 15 and provides for both a "RUN" and a "START" signal. The exact configuration of the ignition circuit connection wiring harness 95 will vary from vehicle to vehicle and is thus universal in design. Also shown leaving the receiver 85 is an antenna 100 which is used to aid in the reception of the signal from the wireless communication path 25 (as shown in FIG. 1) The exact physical arrangement of the receiver 85 and its associated wiring will vary from motor vehicle to motor vehicle and is illustrated here for descriptive purposes only.

Figure 4:
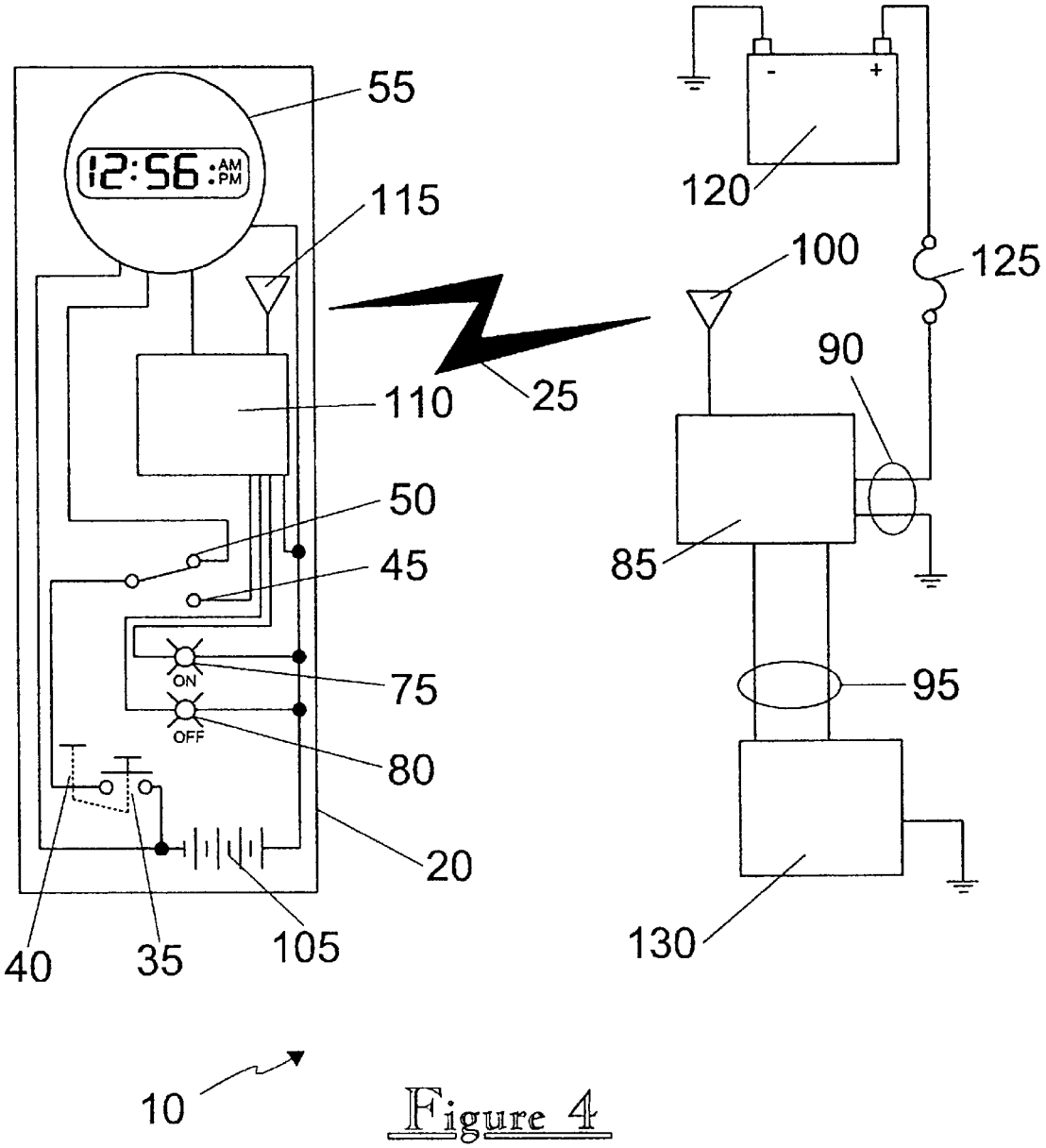
FIG. 4 is a schematic block diagram depicting the major electrical components of the present invention.

Referring next to FIG. 4, a schematic diagram disclosing the major internal electrical components of the remote vehicle starting apparatus with timer 10 is provided. The remote transmitting unit 20 is provided with an internal battery 105 which is replaceable by the user. Power from the internal battery 105 is routed directly to the timing module 55 as well as the ON switch 35 and it's associated OFF switch 40. Power is then routed to the manual switch 45 and the automatic switch 50. It can be seen that in the manual switch 45 position, power is applied directly to an internal transmitter 110 and associated internal antenna 115. In the automatic switch 50 position (as depicted in FIG. 4) power is routed to the timing module 55. This allows the timing module 55 to control the operation of the internal transmitter 110. Control of the timing module 55 as provided by the back light switch 65 and the time set switch 70 are not shown for purposes for clarity. The internal transmitter 110 also provides for the operation of the REMOTE ON indicator light 75 and the REMOTE OFF indicator light 80 to allow the user of the remote vehicle starting apparatus with timer 10 to verify if a start signal has been sent by the internal transmitter 110. The internal transmitter 110, through the internal antenna 115 generates a wireless signal depicted by the wireless communication path 25 as shown. The wireless communication path 25 is received by the antenna 100 of the receiver 85. The receiver 85 receives its operating power from the power connection wiring harness 90 which is connected to vehicle ground and to a vehicle battery 120 through a fuse 125 as shown. The ignition circuit connection wiring harness 95, supplying the "START" and "RUN" signals, is routed to an ignition circuit 130, also referenced to vehicle ground.

Figure 5:
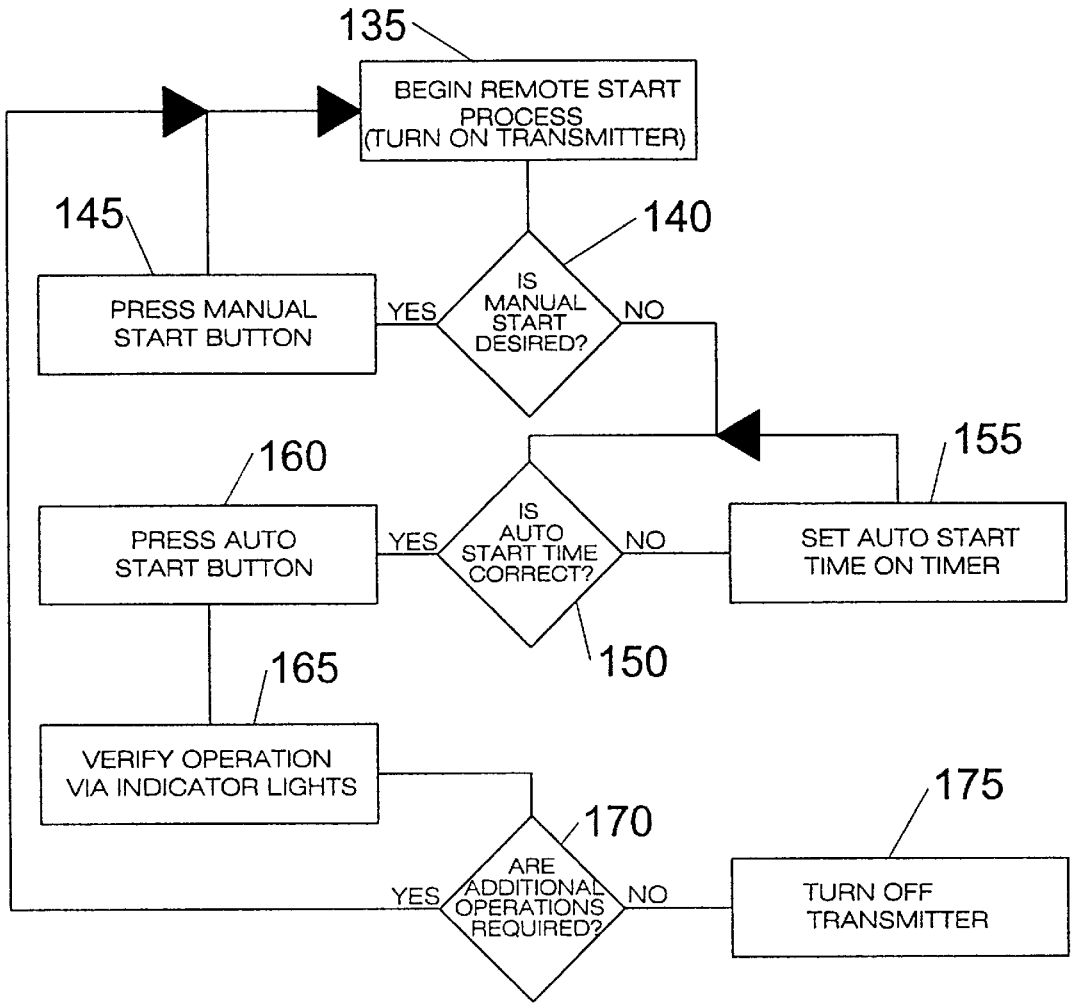
FIG. 5 is a flow chart depicting the decision process used when utilizing the present invention to remotely start a motor vehicle.

Referring finally to FIG. 5, a flow chart depicting the decision process when using the remote vehicle starting apparatus with timer 10 (not shown in this FIG.) is disclosed. The user would begin at a first operational block 135 where the decision to use the remote vehicle starting apparatus with timer 10 has been reached and thus the transmitter 110 has been activated. The process continues at a first functional block 140 where a positive response to a manual start decision results in the manual activation of the remote vehicle starting apparatus with timer 10 via a second operational block 145. After the completion of the second operational block 145, the user then returns to the first operational block 135. A negative response at the first functional block 140 indicates that the user wishes to utilize the remote vehicle starting apparatus with timer 10 in an automatic mode. The user then verifies the proper start times on the timing module 55 (as shown in FIG. 2) via a second functional block 150. A negative response causes the user to set the correct time via an internal antenna 115, whereupon the user will return to the second functional block 150. A positive response to the second functional block 150 allows the user to activate the automatic switch 50 (as shown on FIG. 2) via a fourth operational block 160 and then verify proper operation via a fifth operational block 165 and the REMOTE ON indicator light 75 and the REMOTE OFF indicator light 80 (as shown in FIG. 2) after the set time has passed. The decision if further operations are desired is made at a third functional block 170. A positive response returns the user to the first operational block 135 where the process may begin again. A negative response allows the user to deactivate the remote vehicle starting apparatus with timer 10 at a sixth operational block 175 using the OFF switch 40 (as shown in FIG. 2).

2. Operation of the Preferred Embodiment

In operation, the present invention can be easily utilized by the common user in a simple and effortless manner. To use the present invention with its preferred embodiment can best be described in conjunction with the perspective views of FIG. 1 and FIG. 3, the front view of FIG. 2, the schematic block diagram of FIG. 4, and the flow chart of FIG. 5.

To use the present invention, the user would first install the receiver 85 of the remote vehicle starting apparatus with timer 10 on the motor vehicle 15 by connecting the receiver 85 to the vehicle battery 120 and the ignition circuit 130. The antenna 110 is also deployed inside the motor vehicle 15 to aid in the reception of the wireless communication path 25. The user would then leave the heating or cooling system activated on the motor vehicle 15 before turning it off or leaving it. At this point the remote vehicle starting apparatus with timer 10 is then ready to receive a remote start signal.

When the user wished to start the car from a remote location, the user would take the remote transmitting unit 20 and activate it by pressing the ON switch 35 on the control panel 30. An immediate manual start may then be initiated by pressing the manual switch 45, or an automatic start may be initiated by pressing the automatic switch 50 on the ON switch 35.

To set the automatic start time, the user verifies that the current time is displayed in the digital display 60. If not, the current time is set using the time set switch 70. The desired start time is then set also using the multiple functionality of the time set switch 70, in a similar manner to that found on an electronic wristwatch. If the remote transmitting unit 20 is operated under low-light conditions, the internal back light of the digital display 60 may be activated by the back light switch 65.

The remote transmitting unit 20 will send a start signal via the wireless communication path 25 at the appropriate time to start the motor vehicle 15. The user may override the start signal at any time by pressing the OFF switch 40 on the remote transmitting unit 20 or by resetting a later start time on the timing module 55. The usage of the remote vehicle starting apparatus with timer 10 on a motor vehicle 15 does not prevent the user from starting the motor vehicle 15 using a key in the conventional manner.

While the aforementioned description is envisioned as being utilized with a motor vehicle, it should be understood that it is well within the scope of the present invention that it may be used with all vehicles possessing an internal combustion engine such as a boat, plane, or the like.

The foregoing description is included to illustrate the operation of the preferred embodiment and is not meant to limit the scope of the invention. The scope of the invention is to be limited only by the following claims.

COMPONENT LIST

10 remote vehicle starting apparatus with timer
15 motor vehicle
20 remote transmitting unit
25 wireless communication path
30 control panel
35 ON switch
40 OFF switch
45 manual switch
50 automatic switch
55 timing module
60 digital display
65 back light switch
70 time set switch
75 REMOTE ON indicator light
80 REMOTE OFF indicator light
85 receiver
90 power connection wiring harness
95 ignition circuit connection wiring harness
100 antenna
105 internal battery
110 internal transmitter
115 internal antenna
120 vehicle battery
125 fuse

130 ignition circuit

135 first operational block

140 first functional block

145 second operational block

150 second functional block

155 third operational block

160 fourth operational block

165 fifth operational block

170 third functional block

175 sixth operational block

What is claimed is:

1. A remote vehicle starting apparatus comprising:

a remote transmitting unit having internal high density electronic components being capable of transmitting a low power radio frequency link for developing a wireless communication path;

a timing module, said timing module located on an upper portion of said remote transmitting unit and said timing module consisting of a digital display, a back light switch, a time set switch, a REMOTE ON indicator light and a REMOTE OFF indicator light operated by an internal transmitter, and wherein said digital display is used to view the current time as well as the time at which the motor vehicle will automatically start if so set;

a receiver mounted internal to the engine compartment of a motor vehicle, said receiver connecting to and receiving operating power from a power connection wiring harness and said receiver further connected to an ignition circuit of a motor vehicle by an ignition circuit connection wiring harness, said power connection wiring harness being connected to a vehicle ground and to a vehicle battery through a fuse, said power connection wiring harness being connected so that it always receives a source of electrical power, even when motor vehicle is turned off, and said ignition circuit connection wiring harness providing for both a "RUN" and a "START" signal; and an antenna, said antenna connected to said receiver for aiding in reception of a signal from said wireless communication path.

2. The remote vehicle starting apparatus of claim 1, wherein said digital display includes a Liquid Crystal Display (LCD) and is equipped with "AM" and "PM" indicators to allow for full 24-hour a day operation.

3. The remote vehicle starting apparatus of claim 2, wherein said back light switch allows the digital display to be viewed under low-light conditions and operates in a similar manner to that found on LCD wristwatches.

4. The remote vehicle starting apparatus of claim 2, wherein said time set switch allows for the time of day setting as well as the automatic start time setting.

5. The remote vehicle starting apparatus of claim 2, wherein said timing module is further provided with a REMOTE ON indicator light and a REMOTE OFF indicator light to allow the user to visually see whether a remote start signal was sent to the motor vehicle if the motor vehicle is not within visual range of the user.

* * * * *